US007216959B2

(12) United States Patent
Lim et al.

(10) Patent No.: US 7,216,959 B2
(45) Date of Patent: May 15, 2007

(54) APPARATUS AND METHOD FOR DRIVING AN INK-JET PRINTHEAD

(75) Inventors: Ji-hyuk Lim, Suwon-si (KR); Young-jae Kim, Anyang-si (KR); Yong-soo Oh, Seongnam-si (KR); Seog-soon Baek, Suwon-si (KR); You-seop Lee, Yongin-si (KR); Hyung-taek Lim, Seoul (KR); Chang-seung Lee, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 239 days.

(21) Appl. No.: 10/899,125

(22) Filed: Jul. 27, 2004

(65) Prior Publication Data

US 2005/0024440 A1 Feb. 3, 2005

(30) Foreign Application Priority Data

Jul. 29, 2003 (KR) ..... 10-2003-0052440

(51) Int. Cl.
*B41J 2/05* (2006.01)

(52) U.S. Cl. ..... 347/57; 347/58

(58) Field of Classification Search ..... 347/57–58; 330/262

See application file for complete search history.

(56) References Cited

U.S. PATENT DOCUMENTS

| | | | | |
|---|---|---|---|---|
| 4,015,212 | A * | 3/1977 | Miyata | 330/264 |
| 5,648,805 | A | 7/1997 | Keefe et al. | |
| 5,936,644 | A | 8/1999 | Ono et al. | |
| 6,056,385 | A | 5/2000 | Tamura | |
| 6,193,345 | B1 | 2/2001 | Feinn et al. | 347/12 |

OTHER PUBLICATIONS

Patent Abstracts of Japan, vol. 0130, No. 77 (M-801) Feb. 11, 1989 & JP 63 278858, Seiko Epson.

* cited by examiner

*Primary Examiner*—Stephen Meier
*Assistant Examiner*—Han Samuel Choi
(74) *Attorney, Agent, or Firm*—Lee & Morse, P.C.

(57) ABSTRACT

An apparatus and method for driving an ink-jet printhead in which current is applied to a heater to heat ink to be supplied in an ink chamber to generate a bubble to eject ink from the ink chamber, the apparatus including a circuit that alternately applies current to the heater to alternate a direction of current flowing through the heater.

28 Claims, 4 Drawing Sheets

APPARATUS AND METHOD FOR DRIVING AN INK-JET PRINTHEAD

BACKGROUND OF THE INVENTION

1. Field of the Invention

The present invention relates to an apparatus and method for driving an ink-jet printhead. More particularly, the present invention relates to an apparatus and method for driving a thermal ink-jet printhead that is able to extend a lifespan of a heater by alternately applying current pulses to the heater.

2. Description of the Related Art

In general, ink-jet printheads are devices for printing a predetermined image, color or black, by ejecting a small volume droplet of ink at a desired position on a recording sheet. Ink-jet printheads are generally categorized into two types depending on which ink ejection mechanism is used. A first type is a thermal ink-jet printhead, in which a heat source is employed to form and expand a bubble in ink to cause an ink droplet to be ejected due to the expansive force of the formed bubble. A second type is a piezoelectric ink-jet printhead, in which an ink droplet is ejected by a pressure applied to the ink due to a deformation of a piezoelectric element.

An ink droplet ejection mechanism of a thermal ink-jet printhead will now be explained in detail. When a current pulse is supplied to a heater, which includes a heating resistor, the heater generates heat and ink near the heater is instantaneously heated to approximately 700° C., thereby boiling the ink. The boiling of the ink causes bubbles to be generated and exert pressure on ink filling an ink chamber. As a result, ink around a nozzle is ejected from the ink chamber in the form of a droplet through the nozzle.

A thermal inkjet printhead is classified into a top-shooting type, a side-shooting type, and a back-shooting type depending on a bubble growing direction and a droplet ejection direction. In a top-shooting type of printhead, bubbles grow in the same direction in which an ink droplet is ejected. In a side-shooting type of printhead, bubbles grow in a direction perpendicular to a direction in which an ink droplet is ejected. In a back-shooting type of printhead, bubbles grow in a direction opposite to a direction in which an ink droplet is ejected.

An ink-jet printhead using the thermal driving method should satisfy the following requirements. First, manufacturing of the ink-jet printheads should be simple, costs should be low, and should facilitate mass production thereof. Second, in order to obtain a high-quality image, cross talk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after being ejected from the ink chamber should be as short as possible and the cooling of heated ink and heater should be performed quickly to increase an operating frequency.

FIG. 1 illustrates an exploded perspective view of a conventional thermal ink-jet printhead. FIG. 2 illustrates a cross-sectional view for explaining a process of ejecting an ink droplet using the conventional thermal ink-jet printhead of FIG. 1.

Referring to FIGS. 1 and 2, the conventional thermal ink-jet printhead includes a substrate 10, an ink chamber 26, which is formed on the substrate 10 and stores ink therein, partition walls 14, which define the ink chamber 26, a heater 12, which is disposed within the ink chamber 26, a nozzle 16, through which an ink droplet 29' is ejected, and a nozzle plate 18, through which the nozzle 16 is formed. In operation, a current pulse is supplied to the heater 12 to generate heat, such that ink 29 filled in the ink chamber 26 is heated, thereby generating a bubble 28. The generated bubble 28 is continuously expanded such that pressure is applied to the ink 29 filled in the ink chamber 26, thereby ejecting the ink droplet 29' out of the printhead through the nozzle 16. Subsequently, ink 29 from a manifold 22 is introduced into the ink chamber 26 through an ink channel 24. Resultantly, the ink chamber 26 is refilled with ink 29.

FIG. 3 is a circuit diagram of a first conventional circuit for driving a thermal ink-jet printhead. FIG. 4 is a diagram illustrating pulses of the first conventional circuit of FIG. 3.

Referring to FIGS. 3 and 4, in a circuit to which a positive voltage $V_1$ is constantly applied as a supply voltage pulse $V_{CC}$ to drive an ink-jet printhead, a current pulse $I_H$ is supplied to a thin film heater 30 using a drive signal $S_{DR}$ and a field effect transistor (FET). According to the conventional circuit, since a current flows in a constant direction through the heater 30, damage to the heater 30 may occur due to electromigration. Recently, attempts to reduce an amount of energy applied to a high-density printhead by reducing a thickness of a heater therein have been made. As the heater becomes thinner, however, damage to the heater due to electromigration becomes a more serious problem.

FIG. 5 is a circuit diagram of a second conventional circuit for driving an ink-jet printhead. FIG. 6 is a diagram illustrating pulses of the second conventional circuit of FIG. 5.

Referring to FIGS. 5 and 6, in a circuit to which a supply voltage pulse $V_{CC}$ is supplied to drive an ink-jet printhead, a current pulse $I_H$ is supplied to a heater 50 using a drive signal $S_{DR}$ and a driving electric FET. A current waveform is controlled by means of a pull down resistor and two electric FETs. According to the second conventional circuit, current waveform distortion, such as overshoot, may be reduced, and thus maximum current amplitude is lowered, which results in a decrease in damage to the heater 50 due to electromigration. As mentioned above, the second conventional circuit similarly has a similar in reducing the possibility of damage to the heater 50 that is caused by a decrease in a thickness of the heater 50.

SUMMARY OF THE INVENTION

The present invention is therefore directed to an apparatus and method for driving a thermal ink-jet printhead, which substantially overcome one or more of the problems due to the limitations and disadvantages of the related art.

It is a feature of an embodiment of the present invention to provide an apparatus and a method for driving a thermal ink-jet printhead that are able to extend a lifespan of a heater by alternately applying current pulses to the heater.

It is another feature of an embodiment of the present invention to provide an apparatus and a method for driving a thermal ink-jet printhead that improve reliability of the performance of the ink-jet printhead.

At least one of the above features and other advantages may be provided by an apparatus for driving an ink-jet printhead in which current is applied to a heater to heat ink to be supplied in an ink chamber to generate a bubble to eject ink from the ink chamber, the apparatus including a circuit that alternately applies current to the heater to alternate a direction of current flowing through the heater.

The heater may have a first and a second end and the circuit may include a first switch selectively connecting a positive voltage terminal to the first end of the heater and a second switch selectively connecting a negative voltage terminal to the first end of the heater, wherein the first switch and the second switch are alternately turned on.

The first switch may be an N-channel electric field effect transistor (FET) having a source, a drain, and a gate. The source of the N-channel electric FET may be connected to the first end of the heater. The drain and the gate of the N-channel electric FET may be connected together.

The second switch may be a P-channel electric field effect transistor (FET) having a source, a drain, and a gate. The source of the P-channel electric FET may be connected to the first end of the heater. The drain and the gate of the P-channel electric FET may be connected together.

The circuit may further include a third switch selectively connecting the second end of the heater to a ground terminal. The third switch may be an electric field effect transistor (FET) selectively connecting or disconnecting the second end of the heater to or from the ground terminal in response to a drive signal applied to a gate of the third switch.

The circuit may alternately connect a positive voltage to the heater to flow current through the heater in a first direction and a negative voltage to the heater to flow current through the heater in a second direction, which is opposite to the first direction.

At least one of the above features and other advantages may be provided by a method for driving and ejecting ink from an ink-jet printhead including flowing current in a first direction through a heater for heating ink to be supplied to an ink chamber to generate a bubble to eject ink from the ink chamber, flowing current in a second direction through the heater to generate a bubble to eject ink from the ink chamber, wherein the first direction and the second direction are opposite.

Applying current in the first direction may include connecting a positive voltage terminal to a first end of the heater using a first switch and connecting a ground terminal to a second end of the heater using a third switch. Applying current in the second direction may include connecting a negative voltage terminal to a first end of the heater using a second switch and connecting a ground terminal to a second end of the heater using a third switch. The ground terminal may be selectively connected to the second end of the heater in response to a drive signal applied to the third switch.

At least one of the above features and other advantages may be provided by a method for driving and ejecting ink from an ink-jet printhead including periodically applying a positive voltage to a positive voltage terminal and selectively connecting the positive voltage terminal to the heater, periodically applying a negative voltage to a negative voltage terminal and selectively connecting the negative voltage terminal to the heater through a second switch, periodically applying a positive drive signal to a switch for connecting the heater to a ground terminal whenever either the positive voltage or negative voltage is applied.

Application of the positive voltage to the positive voltage terminal and application of the positive drive signal to the switch may flow current through the heater in a first direction. Application of the negative voltage to the negative voltage terminal and application of the positive drive signal to the switch may flow current through the heater in a second direction, which is opposite to the first direction.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
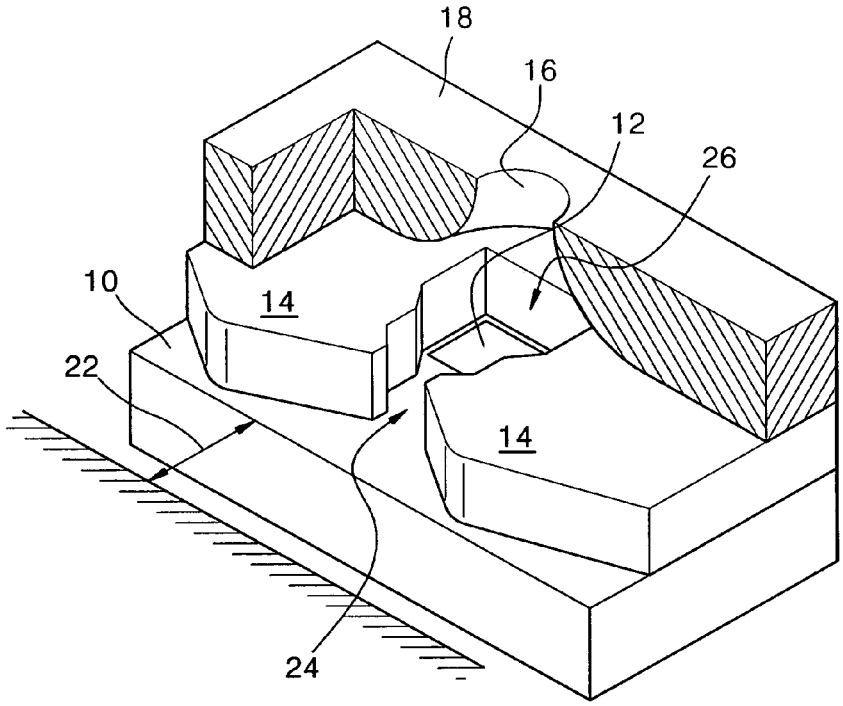
FIG. 1 (PRIOR ART)
FIG. 1 illustrates an exploded perspective view of a conventional thermal ink-jet printhead.
Figure 2:
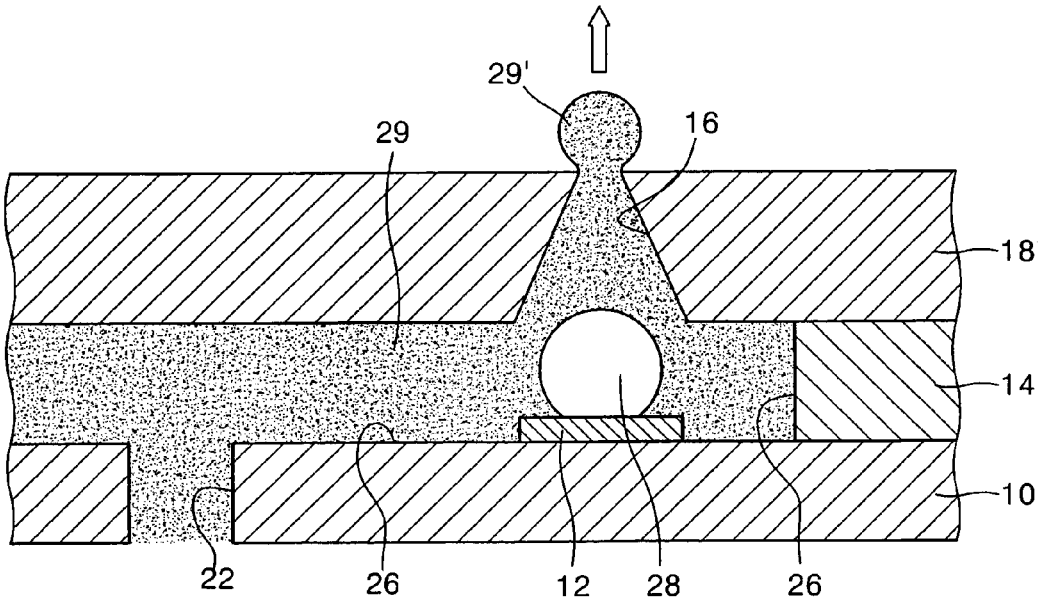
FIG. 2 (PRIOR ART)
FIG. 2 illustrates a cross-sectional view for explaining a process of ejecting an ink droplet using the conventional thermal ink-jet printhead of FIG. 1.
Figure 3:
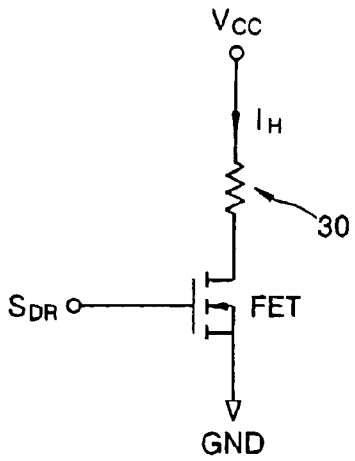
FIG. 3 (PRIOR ART)
FIG. 3 is a circuit diagram of a first conventional circuit for driving a thermal ink-jet printhead.
Figure 4:
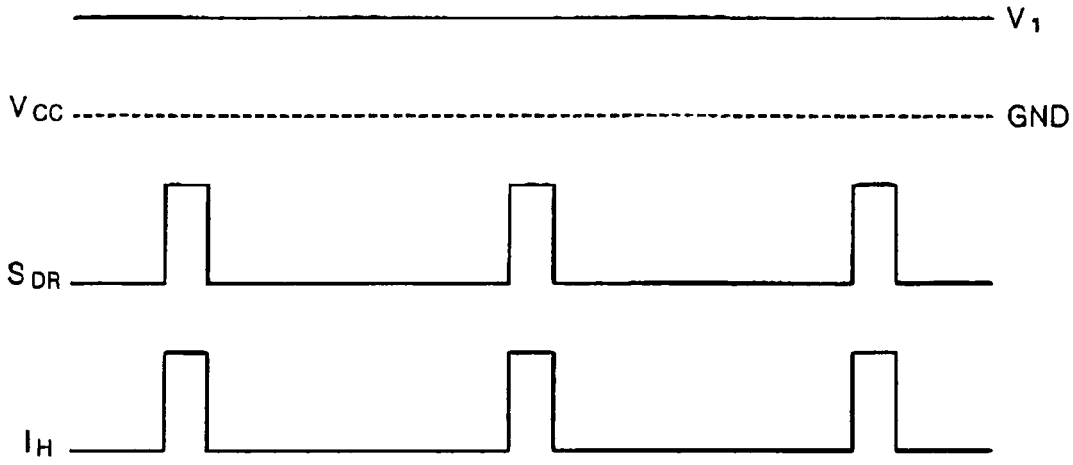
FIG. 4 (PRIOR ART)
FIG. 4 is a diagram illustrating pulses of the first conventional circuit of FIG. 3.
Figure 5:
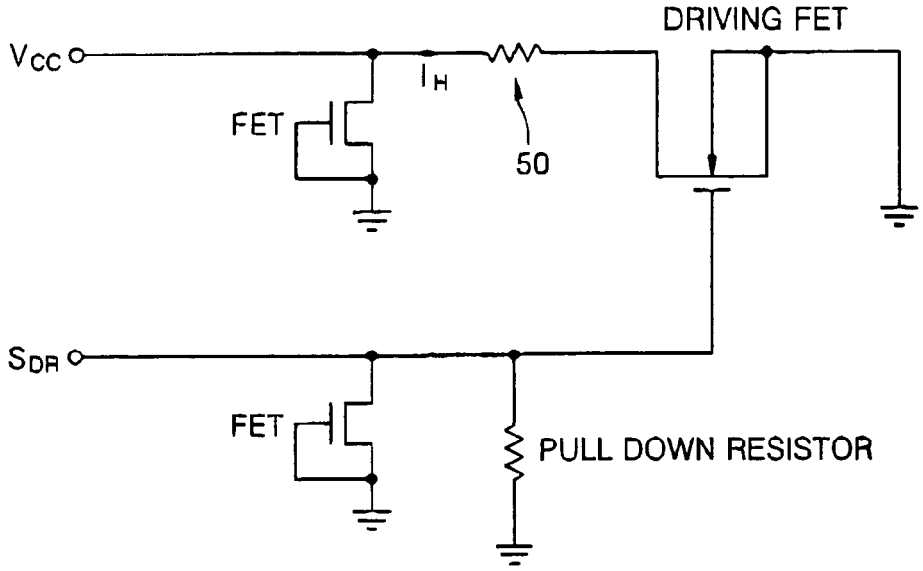
FIG. 5 (PRIOR ART)
FIG. 5 is a circuit diagram of a second conventional circuit for driving a thermal ink-jet printhead.
Figure 6:
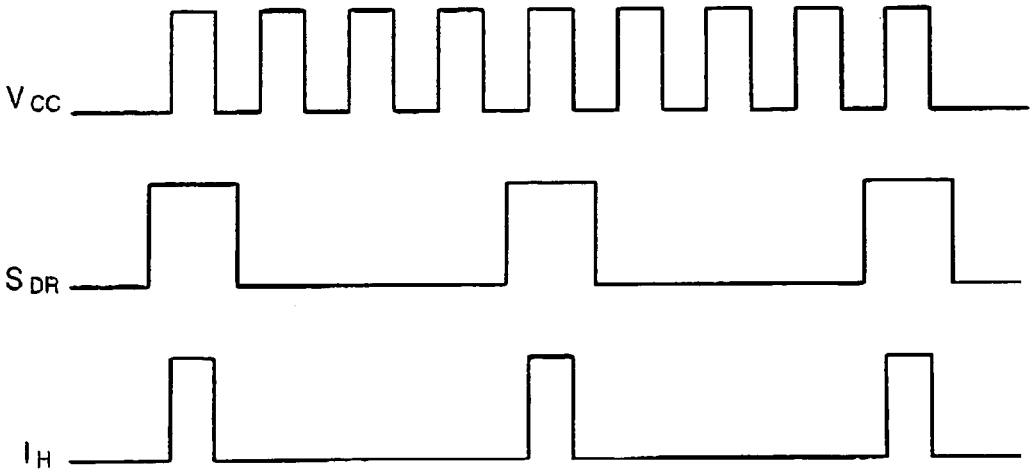
FIG. 6 (PRIOR ART)
FIG. 6 is a diagram illustrating pulses of the second conventional circuit of FIG. 5.

Korean Patent Application No. 2003-52472, filed on Jul. 29, 2003, in the Korean Intellectual Property Office, and entitled: "Apparatus for Driving an Ink-Jet Printhead," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. Like reference numerals refer to like elements throughout.

Figure 7:
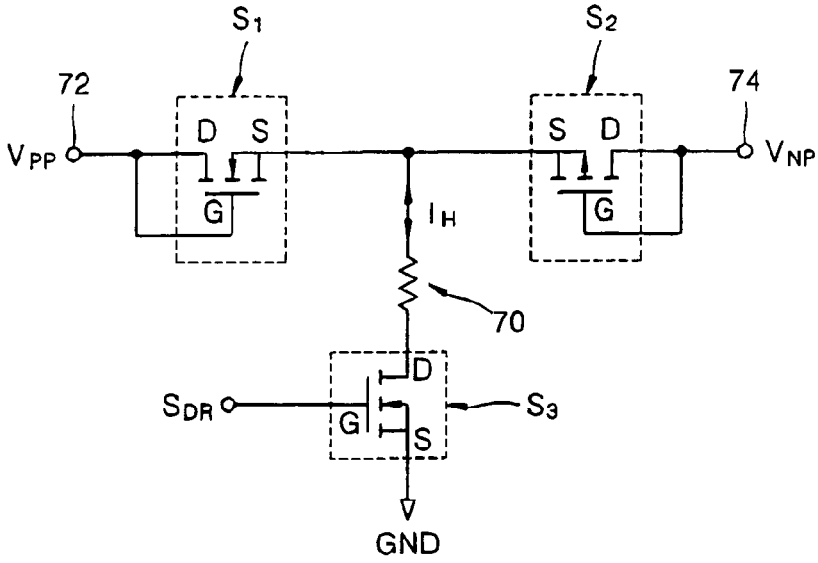
FIG. 7 is a circuit diagram of a circuit for driving a thermal ink-jet printhead according to an embodiment of the present invention.
Figure 8:
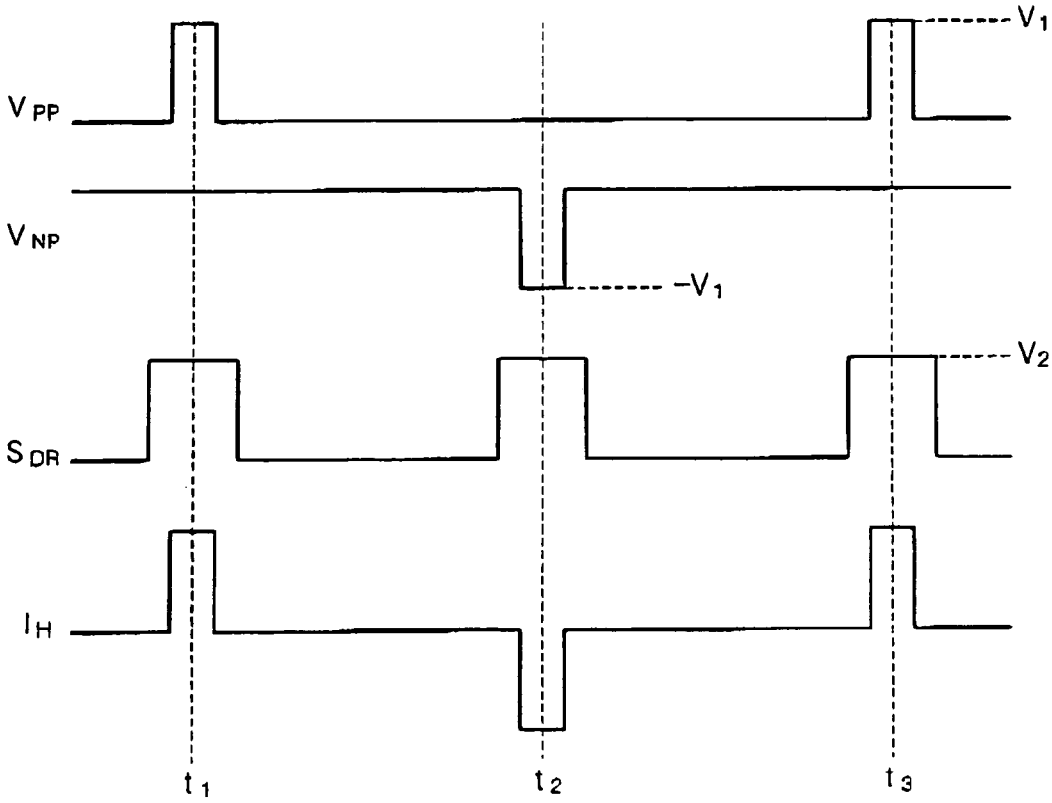
FIG. 8 is a diagram illustrating pulses of the circuit according to an embodiment of the present invention shown in FIG. 7.

FIG. 7 is a circuit diagram of a circuit for driving a thermal ink-jet printhead according to an embodiment of the present invention. FIG. 8 is a diagram illustrating pulses of the circuit according to an embodiment of the present invention shown in FIG. 7.

Referring to FIG. 7, in a circuit for driving an ink-jet printhead, a first end of a heater 70 is connected both to a positive voltage terminal 72 and a negative voltage terminal 74. A high voltage, which is higher than a reference voltage, is applied to the positive voltage terminal 72, and a low voltage, which is lower than the reference voltage, is applied to the negative voltage terminal 74. For convenience of description, a ground voltage is referred to as the reference voltage in connection with FIG. 7. Resultantly, a positive voltage pulse $V_{PP}$ is supplied to the positive voltage terminal 72, and a negative voltage pulse $V_{NP}$ is supplied to the negative voltage terminal 74.

To alternately apply current pulses to the heater 70, a first switch $S_1$ is disposed between the positive voltage terminal 72 and the first end of the heater 70, and a second switch $S_2$ is disposed between the negative voltage terminal 74 and the first end of the heater 70.

In this exemplary embodiment of the present invention, the first switch $S_1$ is an N-channel electric FET. A source S of the N-channel electric FET is connected to the first end of the heater 70. A drain D and a gate G of the N-channel electric FET are connected together. Therefore, when a predetermined positive voltage is supplied to the positive voltage terminal 72, the first switch $S_1$ allows the positive voltage terminal 72 to be connected to the first end of the heater 70, causing a current to flow through the heater 70. However, the N-channel electric FET may be driven by an external drive signal other than the positive voltage.

In this exemplary embodiment of the present invention, the second switch $S_2$ is a P-channel electric FET. A source S of the P-channel electric FET is connected to the first end of the heater 70. A drain D and a gate G of the P-channel electric FET are connected together. Therefore, when a predetermined negative voltage is supplied to the negative voltage terminal 74, the second switch $S_2$ allows the negative voltage terminal 74 to be connected to the first end of the terminal 70, causing current to flow through the heater 70. However, the P-channel electric FET may be driven by an external drive signal other than the negative voltage.

In addition to the first and second switches $S_1$ and $S_2$, a third switch $S_3$ may be disposed between a second end of the heater 70 and a ground terminal GND to selectively connect or disconnect the second end of the heater 70 to or from a ground terminal GND.

In this embodiment, the third switch $S_3$ is an electric FET. The electric FET selectively connects or disconnects the second end of the heater 70 to or from the ground terminal GND in response to a drive signal $S_{DR}$ applied to a gate of the third switch $S_3$. Although the third switch $S_3$ is illustrated as an N-channel electric FET in FIG. 7, the third switch $S_3$ may alternatively be a P-channel electric FET.

FIG. 8 is a diagram illustrating the positive voltage pulse $V_{PP}$ that is supplied to the positive voltage terminal 72, the negative voltage pulse $V_{NP}$ that is supplied to the negative voltage terminal 74, and the drive signal $S_{DR}$ that is applied to the electric FET acting as the third switch $S_3$.

Referring to FIG. 8, a predetermined positive voltage $V_1$ is periodically applied to the positive voltage terminal 72, and a predetermined negative voltage $-V_1$ is periodically applied to the negative voltage terminal 74. The negative voltage $-V_1$ is applied at a time $t_2$ that is halfway between a time $t_1$ when a first positive voltage $V_1$ is applied and a time $t_3$ when a second positive voltage $V_1$ is applied. A positive drive signal voltage $V_2$ is periodically applied to the electric FET acting as the third switch $S_3$ whenever either the positive voltage $V_1$ or the negative voltage $-V_1$ is applied.

A principle of alternately applying current pulses to the heater 70 in the ink-jet printhead driving circuit according to the exemplary embodiment of the present invention will now be explained.

When a first positive voltage $V_1$ is supplied to the positive voltage terminal 72 at a time $t_1$, the N-channel electric FET acting as the first switch $S_1$ connects the positive voltage terminal 72 to the first end of the heater 70. At this time, since no voltage is supplied to the negative voltage terminal 74, the P-channel electric FET acting as the second switch $S_2$ disconnects the negative voltage terminal 74 from the first end of the heater 70. If a positive drive signal voltage $V_2$ is applied to the electric FET acting as the third switch $S_3$ at time $t_1$, the electric FET acting as the third switch $S_3$ connects the second end of the heater 70 to the ground terminal GND. Accordingly, a current flows from the positive voltage terminal 72 through the heater 70 toward the ground terminal GND at time $t_1$. Hence, current flows in a forward direction, i.e., downwardly, through the heater 70 at time $t_1$.

When a negative voltage $-V_1$ is supplied to the negative voltage terminal 74 at a time $t_2$, the P-channel electric FET acting as the second switch $S_2$ connects the negative voltage terminal 74 to the first end of the heater 70. At this time, since no voltage is supplied to the positive voltage terminal 72, the N-channel electric FET acting as the first switch $S_1$ disconnects the positive voltage terminal 72 from the first end of the heater 70. If a positive drive signal voltage $V_2$ is applied to the electric FET acting as the third switch $S_3$ at time $t_2$, the electric FET acting as the third switch $S_3$ connects the second end of the heater 70 to the ground terminal GND. Accordingly, a current flows from the ground terminal GND through the heater 70 toward the negative voltage terminal 74 at time $t_2$. Hence, current flows in a reverse direction, i.e., upwardly, through the heater 70 at time $t_2$. Thus, a direction in which current flows through the heater 70 at time $t_2$ is opposite to a direction in which current flows through the heater 70 at time $t_1$.

Subsequently, when a second positive voltage $V_1$ is supplied to the positive voltage terminal 72 at a time $t_3$ and a positive drive signal voltage $V_2$ is applied to the electric FET acting as the third switch $S_3$, a current flows through the heater 70 in the same forward direction as that at time $t_1$.

If the above procedures are repeated, current pulses are alternately applied to the heater 70 at periodic intervals, thereby alternating a direction of current flow through the heater 70.

When a current is alternately applied to the heater 70 of the ink-jet printhead at periodic intervals, the possibility of causing a defect in an atomic structure by an electron wind force, which is generated by current flow, is reduced. This reduction occurs because a possibility of damage at a position where electron flow starts is reduced to half when current flows alternately through the heater 70 as compared to when current flows in only one direction. Thus, if current flows periodically and alternately through the heater 70, the possibility of damage to the heater 70 is reduced as compared to when current flows in a single direction.

As described above, an apparatus for driving an ink-jet printhead according to an embodiment of the present invention may have the following advantages.

First, since current can alternately flow through the heater, the possibility of damage to the heater due to electromigration is reduced to half of that when a current flows in only one direction. Accordingly, a time until the heater becomes damaged is delayed, thereby extending a lifespan of the heater.

Second, since a direction of current flowing through the heater is not related to an amount of thermal energy generated by the heater, a circuit for driving an ink-jet printhead according to an embodiment of the present invention is able to provide the same performance as a conventional circuit. Consequently, the reliability of the ink-jet printhead may be improved by modifying the drive circuit without specifically enhancing a quality of the heater.

Exemplary embodiments of the present invention have been disclosed herein and, although specific terms are employed, they are used and are to be interpreted in a generic and descriptive sense only and not for purpose of limitation. For example, each element of the ink-jet printhead may be made of a material other than those mentioned, and the specific figures suggested in each step are variable within a range where the manufactured ink-jet printhead can normally operate. Accordingly, it will be understood by those of ordinary skill in the art that various changes in form and details may be made without departing from the spirit and scope of the present invention as set forth in the following claims.

What is claimed is:

1. An apparatus for driving an ink-jet printhead, comprising:

a heater including a first end and a second end, wherein the heater is configured to heat ink and generate a bubble to eject ink from an ink chamber; and a circuit configured to alternately apply current to the heater to alternate a direction of current flowing through the heater, the circuit including a plurality of switches connected to the first end of the heater, wherein the plurality of switches includes:

a first switch selectively connecting a positive voltage terminal to the first end of the heater; and a second switch selectively connecting a negative voltage terminal to the first end of the heater, wherein the first switch and the second switch are alternately turned on.

2. The apparatus as claimed in claim 1, wherein the first switch is an N-channel electric field effect transistor (FET) having a source, a drain, and a gate.

3. The apparatus as claimed in claim 2, wherein the source of the N-channel electric FET is connected to the first end of the heater.

4. The apparatus as claimed in claim 3, wherein the drain and the gate of the N-channel electric FET are connected together.

5. The apparatus as claimed in claim 1, wherein the second switch is a P-channel electric field effect transistor (FET) having a source, a drain, and a gate.

6. The apparatus as claimed in claim 5, wherein the source of the P-channel electric FET is connected to the first end of the heater.

7. The apparatus as claimed in claim 6, wherein the drain and the gate of the P-channel electric FET are connected together.

8. The apparatus as claimed in claim 1, wherein the circuit further includes a third switch selectively connecting the second end of the heater to a ground terminal.

9. The apparatus as claimed in claim 8, wherein the third switch is an electric field effect transistor (FET) selectively connecting or disconnecting the second end of the heater to or from the ground terminal in response to a drive signal applied to a gate of the third switch.

10. The apparatus as claimed in claim 1, wherein the circuit alternately connects a positive voltage to the heater to flow current through the heater in a first direction and a negative voltage to the heater to flow current through the heater in a second direction, which is opposite to the first direction.

11. An apparatus for driving and ejecting ink from an ink-jet printhead, comprising:

a heater for heating ink to be supplied in an ink chamber to generate a bubble to eject ink from the ink chamber, the heater including a first end and a second end; and means for alternately applying current to the heater to alternate a direction of current flowing through the heater, the means for alternately applying current to the heater including a plurality of switches connected to the first end of the heater, wherein the means for alternately applying current to the heater includes:

a first switch selectively connecting a positive voltage terminal to the first end of the heater; and a second switch selectively connecting a negative voltage terminal to the first end of the heater, wherein the first switch and the second switch are alternately turned on.

12. The apparatus as claimed in claim 11, wherein the first switch is an N-channel electric field effect transistor (FET) having a source, a drain, and a gate.

13. The apparatus as claimed in claim 12, wherein the source of the N-channel electric FET is connected to the first end of the heater.

14. The apparatus as claimed in claim 13, wherein the drain and the gate of the N-channel electric FET are connected together.

15. The apparatus as claimed in claim 11, wherein the second switch is a P-channel electric field effect transistor (FET) having a source, a drain, and a gate.

16. The apparatus as claimed in claim 15, wherein the source of the P-channel electric FET is connected to the first end of the heater.

17. The apparatus as claimed in claim 16, wherein the drain and the gate of the P-channel electric FET are connected together.

18. The apparatus as claimed in claim 11, wherein the means for alternately applying current to the heater further includes a third switch selectively connecting the second end of the heater to a ground terminal.

19. The apparatus as claimed in claim 18, wherein the third switch is an electric field effect transistor (FET) selectively connecting or disconnecting the second end of the heater to or from the ground terminal in response to a drive signal applied to a gate of the third switch.

20. The apparatus as claimed in claim 11, wherein the means for alternately applying current to the heater alternately connects a positive voltage to the heater to flow current through the heater in a first direction and a negative voltage to the heater to flow current through the heater in a second direction, which is opposite to the first direction.

21. A method for driving and ejecting ink from an ink-jet printhead, comprising:

applying a first voltage and second voltage to a plurality of switches connected to a first end of a heater and applying a reference voltage to a switch connected to a second end of the heater;

flowing current in a first direction through the heater to generate a bubble to eject ink from an ink chamber;

flowing current in a second direction through the heater to generate a bubble to eject ink from the ink chamber, wherein the first direction and the second direction are opposite, and the first voltage, the second voltage and the reference voltage are all different voltages.

22. The method as claimed in claim 21, wherein flowing current in the first direction includes connecting a positive voltage terminal to the first end of the heater using a first switch and connecting a ground terminal to the second end of the heater using a third switch.

23. The method as claimed in claim 21, wherein flowing current in the second direction includes connecting a negative voltage terminal to the first end of the heater using a second switch and connecting a ground terminal to the second end of the heater using a third switch.

24. The method as claimed in claim 22, wherein the ground terminal is selectively connected to the second end of the heater in response to a drive signal applied to the third switch.

25. The method as claimed in claim 23, wherein the ground terminal is selectively connected to the second end of the heater in response to a drive signal applied to the third switch.

26. A method for driving and ejecting ink from an ink-jet printhead, comprising:

periodically applying a positive voltage to a positive voltage terminal and selectively connecting the positive voltage terminal to the heater through a first switch;

periodically applying a negative voltage to a negative voltage terminal and selectively connecting the negative voltage terminal to the heater through a second switch;

periodically applying a positive drive signal to a switch for connecting the heater to a ground terminal when ever either the positive voltage or negative voltage is applied.

27. The method as claimed in claim 26, wherein application of the positive voltage to the positive voltage terminal and application of the positive drive signal to the switch flows current through the heater in a first direction.

28. The method as claimed in claim 27, wherein application of the negative voltage to the negative voltage terminal and application of the positive drive signal to the switch flows current through the heater in a second direction, which is opposite to the first direction.

* * * * *